US008117856B2

(12) United States Patent
Stein

(10) Patent No.: US 8,117,856 B2
(45) Date of Patent: Feb. 21, 2012

(54) METHOD AND ASSEMBLY FOR SERVING WINE TABLESIDE

(76) Inventor: Chazon Stein, North Miami Beach, FL (US)

( * ) Notice: Subject to any disclaimer, the term of this patent is extended or adjusted under 35 U.S.C. 154(b) by 537 days.

(21) Appl. No.: 12/403,411

(22) Filed: Mar. 13, 2009

(65) Prior Publication Data

US 2010/0233343 A1 Sep. 16, 2010

(51) Int. Cl.
*C09K 5/04* (2006.01)

(52) U.S. Cl. ..... 62/114; 62/457.2

(58) Field of Classification Search ..... 62/62, 457.2, 62/457.3, 457.4, 457.5, 457.6, 457.8, 258, 62/114; 220/574.2, 592.02, 592.18; 426/592; 29/700

See application file for complete search history.

(56) References Cited

U.S. PATENT DOCUMENTS

| | | | | |
|---|---|---|---|---|
| 5,096,095 | A * | 3/1992 | Burton | 222/173 |
| 5,555,746 | A * | 9/1996 | Thompson | 62/457.4 |
| 6,019,245 | A * | 2/2000 | Foster et al. | 220/739 |
| 6,200,488 | B1 * | 3/2001 | Crowley et al. | 210/758 |
| 6,228,259 | B1 * | 5/2001 | Schwartz et al. | 210/198.1 |
| 2001/0045272 | A1 * | 11/2001 | Emerick et al. | 165/132 |
| 2006/0010903 | A1 * | 1/2006 | Porter | 62/457.3 |
| 2007/0033959 | A1 * | 2/2007 | Anthony | 62/371 |

* cited by examiner

*Primary Examiner* — Mohammad Ali
(74) *Attorney, Agent, or Firm* — David W Barman

(57) ABSTRACT

A system and method that configures a connecting relationship between two wine bottles (or one wine bottle with two wine compartments) such that wine in one bottle/compartment may be served chilled and wine in a second bottle/compartment may be served at a higher temperature than the chilled bottle, while both wines are presented tableside from a single holding vessel.

7 Claims, 11 Drawing Sheets

22
18
20

16
12
14

22
18
20
C
C
26
24

SECTION A-A OF FIG.5

SECTION B-B FROM FIG.1

SECTION C-C OF FIG.13

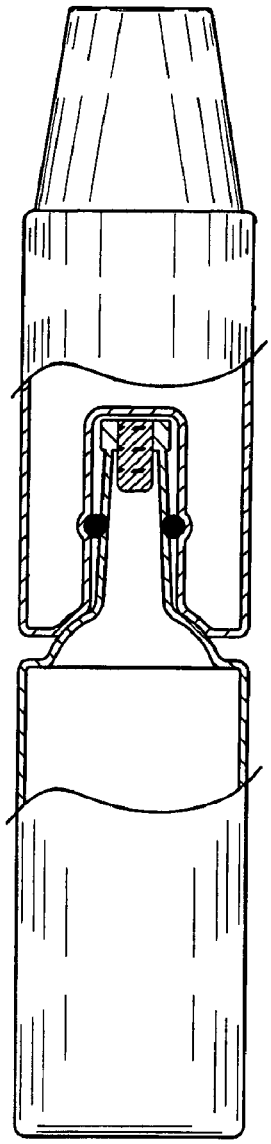
FIG.15
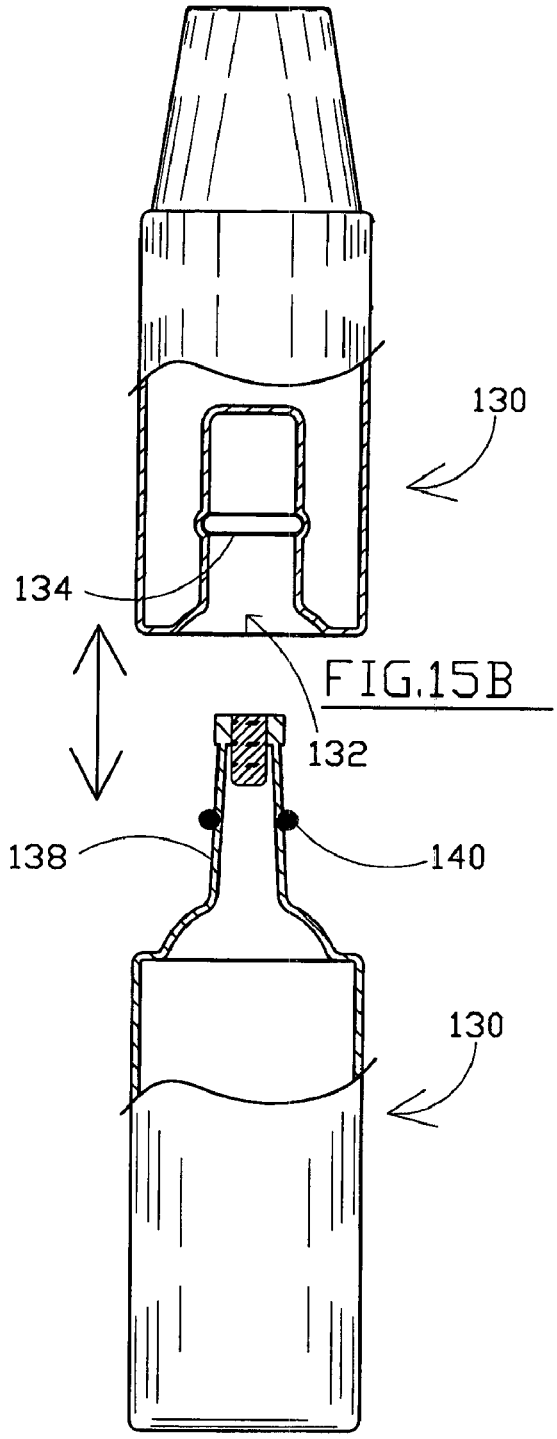
FIG.15B
FIG.15A

METHOD AND ASSEMBLY FOR SERVING WINE TABLESIDE

BACKGROUND OF THE INVENTION

In elegant and upscale dining, it is common to serve wine tableside. It is well known that red wine and white wine are to be served at different temperatures. However, their optimum storage temperature is the same (53-57° F.). Stored wine is defined as, the place wine is kept when one is riot drinking it, be it for a day, a week, or a year, etc. Although the temperature at which wine is stored at is important, it's just as important to take note of the temperature at which wine is served.

Because of the difference in storage temperatures and service temperatures for red wine and white wine, users who use a single temperature wine refrigerator, are often required to place the white wine into a refrigerator for a half an hour prior to service and the red wine must be taken out of storage a half an hour prior to service (this allows time for white wine to chill and red wine to increase from the storage temperature).

Yet if one does not use this kind of storing method, but instead the wine is kept at room temperature or in a conventional refrigerator (which can be as cold as 40° F.). The opposite steps would be taken. Put the red wine in the refrigerator for a half an hour and take the white wine out of the refrigerator for a half an hour (this allows for the white wine to increase from the refrigerator temperature and the red wine to decrease from the room temperature).

Ideally, white wine should be served between refrigerator temperature (40° F.) and storage temperature (55° F.) and red wine should be served somewhere between storage temperature (55° F.) and room temperature of about 70° F. While, red wine and white wine both have different ideal serving temperature, they both have the same ideal storage temperature (53-57° F.); however, they are not always stored at the same temperature or even at their ideal storage temperature.

As can be seen in a case, whereby a user would like to be able to take wine directly from storage and immediately serve it.

In order for red wine and white wine to be immediately servable, at its appropriate service temperatures, when they are taken directly from storage. Both wines will have had to have been stored previously in a two temperature wine refrigerator or in two different single temperature wine refrigerators (each one set at different but appropriate temperatures). Here the white wine is kept at around 47 degrees and the red wine is kept at around 56 degrees.

It should be noted, that even though these wines were able to be served immediately after they were taken from their storage. They will still often be kept in different locations, in order to keep their appropriate serving temperatures.

From these examples, it can be seen, that regardless of the manner in which red wine and white wine are stored (together or in separate locations), when these wines are served, they will often be required to be held in different location, in order to accommodate their different desired serving temperatures. This is why red wine is typically placed on a table and white wine is typically placed in an ice bucket or the other way around (depending on the way the wine had been previously stored).

The present invention provided, allows for both red wine and white wine, to be able to be stored in any appropriate manner and regardless of the manner at which the user has chosen to store the wine (room temperature, conventional refrigerator, a two temperature wine refrigerator unit or one or two single temperature wine refrigerator units).

The wine will be able to be served at their appropriate service temperature; while at the same time allowing them to be located in the same location.

The system and method of the present invention addresses the need and desire to serve white wine and red wine tableside from a single holding vessel.

BRIEF SUMMARY OF THE INVENTION

The present invention holds the red and white wine into one configuration and in one location. This is done so that when the wine is in served, the configuration will be able to accommodating the necessary service temperatures, for both the red wine and the White wine.

The present invention allows both red wine and white wine to be stored in each of their usual accustomed environments, whereby they may be both stored together or in different locations. This is possible because the user has the ability to separate the said configuration in to two parts that may be placed in two different locations, to accommodate different storage means.

However, it should be noted that the present invention is the accommodation of service temperatures for both red and white wine, from within one single configuration, held in one location and that any configuration arranged in such a way to accommodate the service temperatures for both red and white wine, from within one single configuration, held in one location. Will be considered an infringement of the teaching disclosed herein, regardless of the configurations ability or inability to separate in to two parts.

The present invention is a system of connecting two bottles having:

a. a first bottle constructed and arranged with a connection means; and b. a second bottle constructed and arranged with a connection means;

wherein each of said first bottle connection means and said second bottle connection means secure two bottles in a configuration that provides only a single bottle be at least partially placed in ice or ice with water when connected bottles are placed in a tableside bottle serving chiller.

In a preferred embodiment, the bottles are detachably connected.

In a preferred embodiment, the system connecting means is a male-female snap fit configuration. Alternatively, either or both of said first bottle connection means and said second bottle connection means is a plurality of spring-loaded locking pins.

In one embodiment, one of either said first bottle connection means and said second bottle connection means is a connecting collar.

In yet another embodiment, each of said first bottle connection means and said second bottle connection means are spring loaded locking pins and each bottle is joined by interaction with a connecting collar.

Said first bottle connection means and said second bottle connection means, in one embodiment, are bottle sleeves constructed and arranged with one open end and one closed end, at least one spring positioned in an interior base region of said closed end, said spring urges a bottle placed therein towards said open end, said bottle urged against a locking ring placed around a bottleneck.

Although many of the embodiments depict bottles that are detachably connected one to another, it is also contemplated that permanently connected bottles constructed and arranged to achieve the goals of service at different service temperatures.

Also contemplated as part of the present invention is a method of serving wine tableside comprising:

a. selecting a first wine to be served chilled;

b. selecting a second wine to be served at under room temperature;

c. providing a system according to claim 1;

d. providing a vessel containing ice, cold water, or a combination thereof;

e. connecting each of said first and second bottles, said first wine residing in said first bottle and said second wine residing in said second bottle;

f. placing said first bottle in said vessel;

g. waiting a sufficient time for said first wine in said first bottle to chill;

h. removing said system from said vessel;

i. serving wine selected from said first wine, said second wine, or a combination thereof.

BRIEF DESCRIPTION OF THE DRAWINGS

FIG. 15 is a partial section side view of a first bottle nesting on a second bottle.

FIG. 15A is a partial section side view of the second bottle from FIG. 15.

FIG. 15B is a partial section side view of the first bottle from FIG. 15.

DETAILED DESCRIPTION OF THE PREFERRED EMBODIMENTS

Figures 1, 2A, 2B:
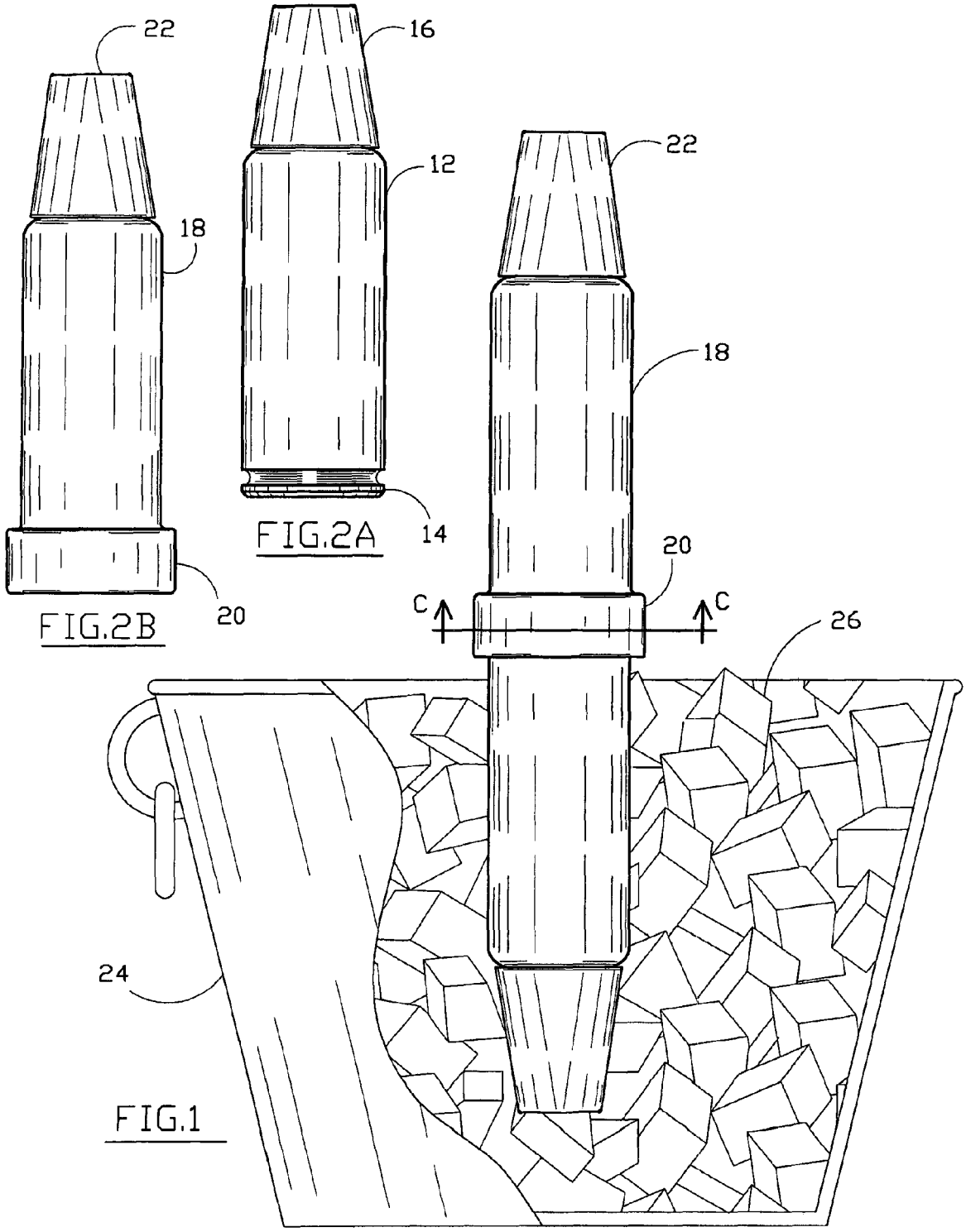
FIG. 1 is a side view and partial section view of connected bottles in an ice bucket.
FIG. 2A is a side view of a wine bottle with a male snap fit arrangement formed on the base of the bottle.
FIG. 2B is a side view of a wine bottle with a female snap fit arrangement formed on the base of the bottle.

The present invention may be accomplished in any of the varied embodiments set forth herein. As shown in FIGS. 1, 2A, and 2B, a first bottle 18 has a basic constructs and arranged with a snap fit female connector 20. Snap fit female connector 20 is complementary with male snap fit connector 14 that is constructed and arranged on a base of second bottle 12.

Although, FIG. 1, depicts a single in embodiments where first bottle 18 is positioned vertically above second bottle 12 in a vessel 24 containing ice 26, it is contemplated that any of the end to end bottle arrangements may be similarly utilized.

Figure 3:
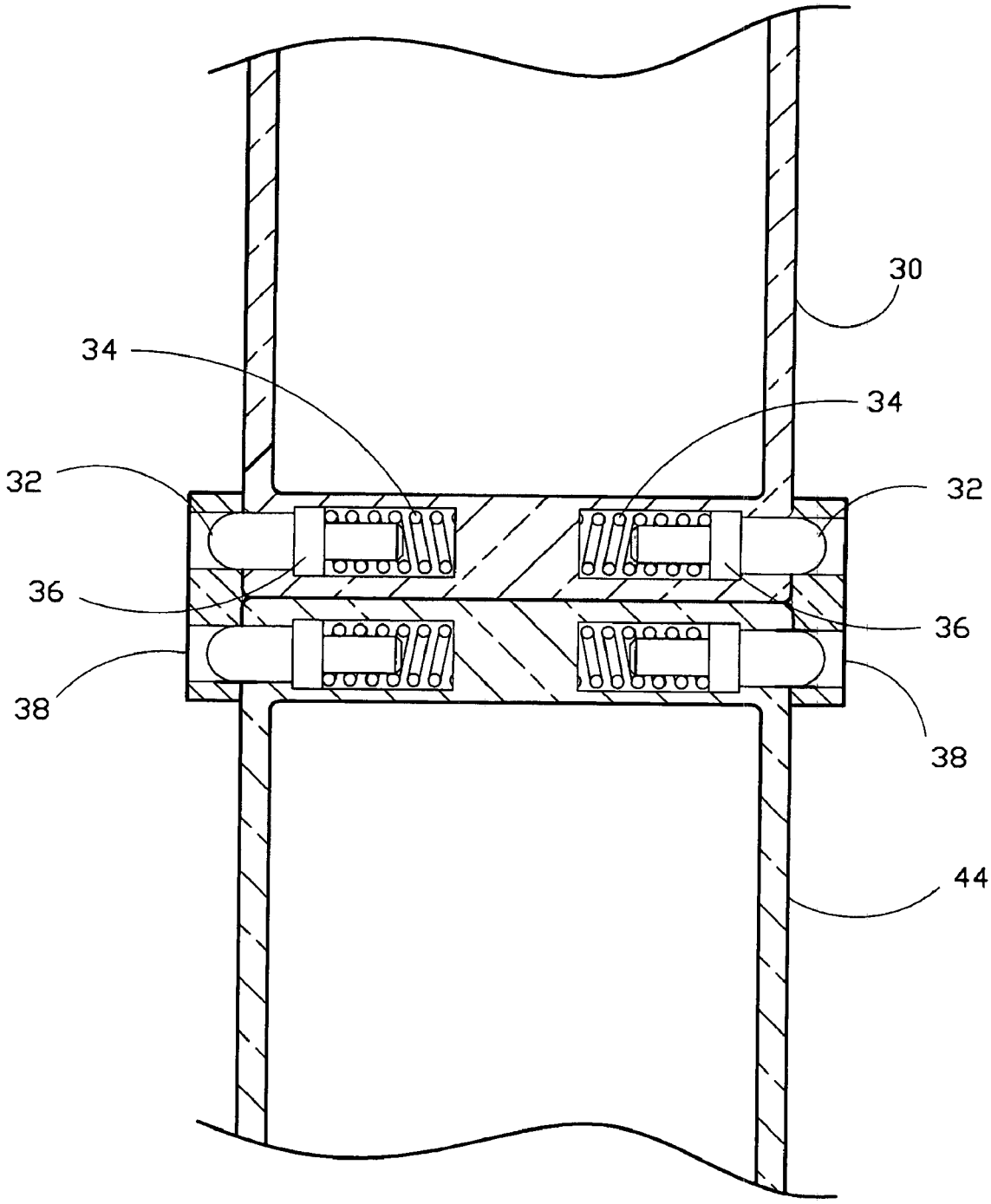
FIG. 3 is a partial sectional side view of locking pins incorporated into the base of each bottle and the bottles secured one to another with a securing ring.
Figure 4:
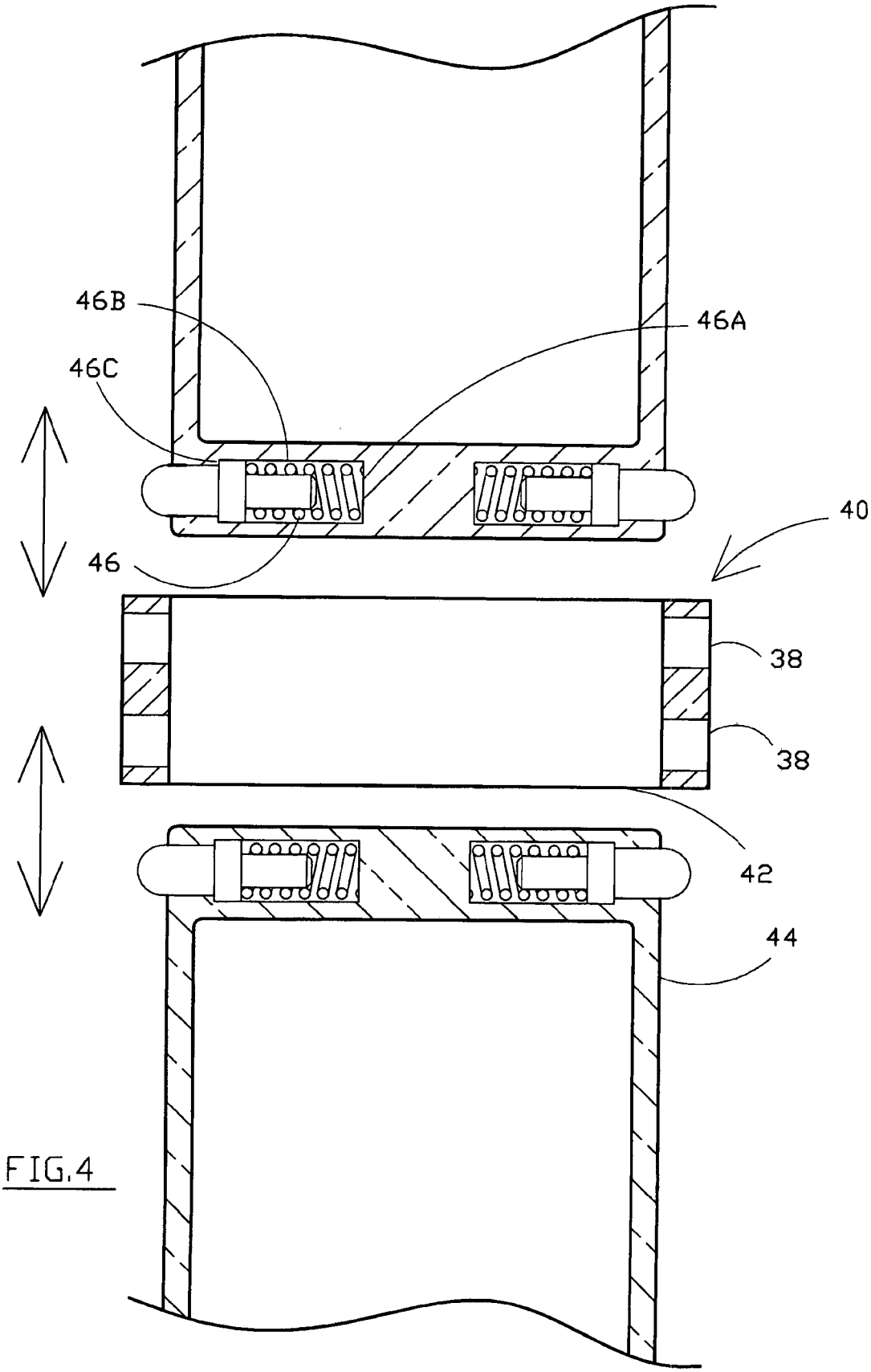
FIG. 4 is a partial sectional side view of locking pins incorporated into the base of each bottle and separated from one another above and below a securing ring.
Figure 5:
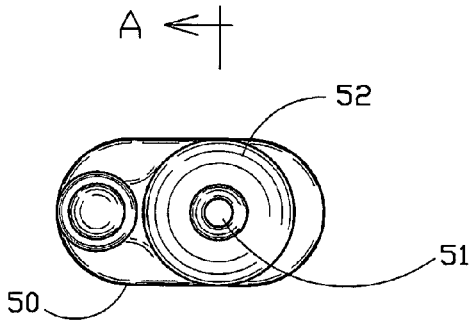
FIG. 5 is a top view of an embodiment having one bottle on a flat platform area of a second bottle.
Figure 8:
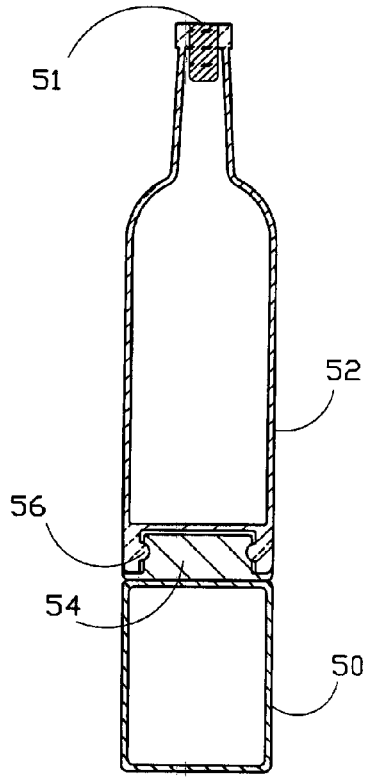
FIG. 8 is a front section view along line A-A of FIG. 5 of an embodiment having one bottle snap fit on a flat platform area of a second bottle.
Figure 6:
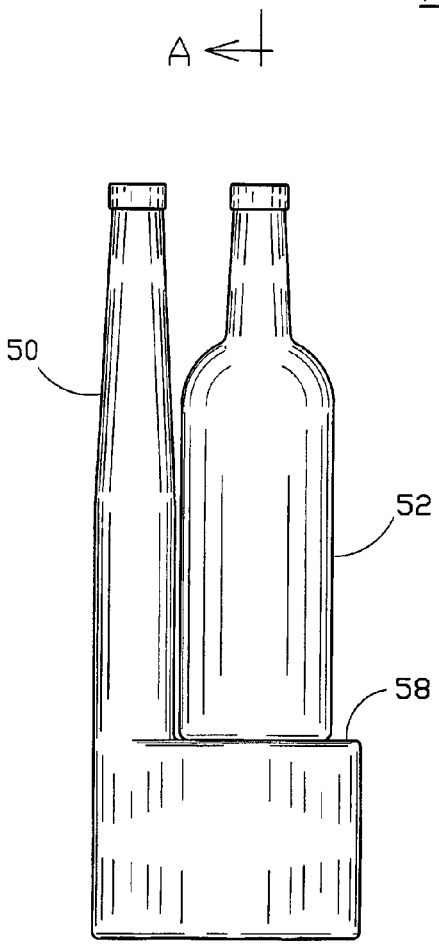
FIG. 6 is a side view of an embodiment having one bottle on a flat platform area of a second bottle.
Figure 7:
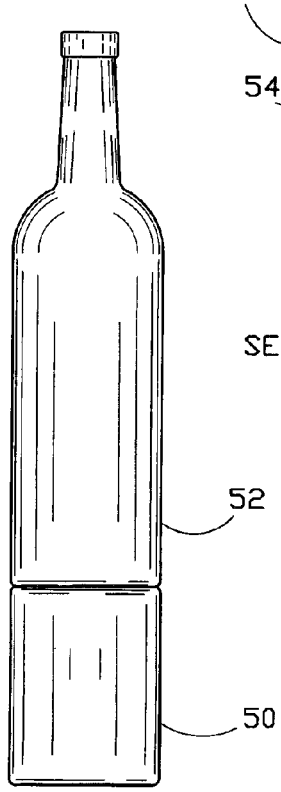
FIG. 7 is a front view of an embodiment having one bottle on a flat platform area of a second bottle.

Indeed embodiments depicted in FIGS. 3 and 4, each of a first bottle 30 and the second bottle 44 are constructed and arranged with interlocking spring-loaded pins 32 incorporated into the base of each respective first bottle 30 and second bottle 44. Each pin 32 is placed in cavity 46. Cavity 46 is defined by a rear wall 46*a*, a circumferential side wall 46*b* and front wall 46*c*. Pin 32 is urged outward by spring 34 placed within cavity 46.

First bottle 30 and second bottle 44 are secured at each base by placing each respective bottle 30 and bottle 44 into cavity 42 of connecting collar 40. Each pin 32 will recede under pressure during insertion a bottle into connecting collar 40. When pin 32 is aligned with collar orifice 38, and 32 is urged outward through collar orifice 38 by spring 34.

In the embodiment depicted in FIGS. 5-8, a base bottle 50 is constructed and arranged to secure a nesting model 52 thereupon. Base bottle 50 has nesting plaque 458 constructed and arranged with male interconnect 54 that interacts with female interconnect 56. Female interconnect 56 is formed in the base of nesting bottle 52.

Figure 9:
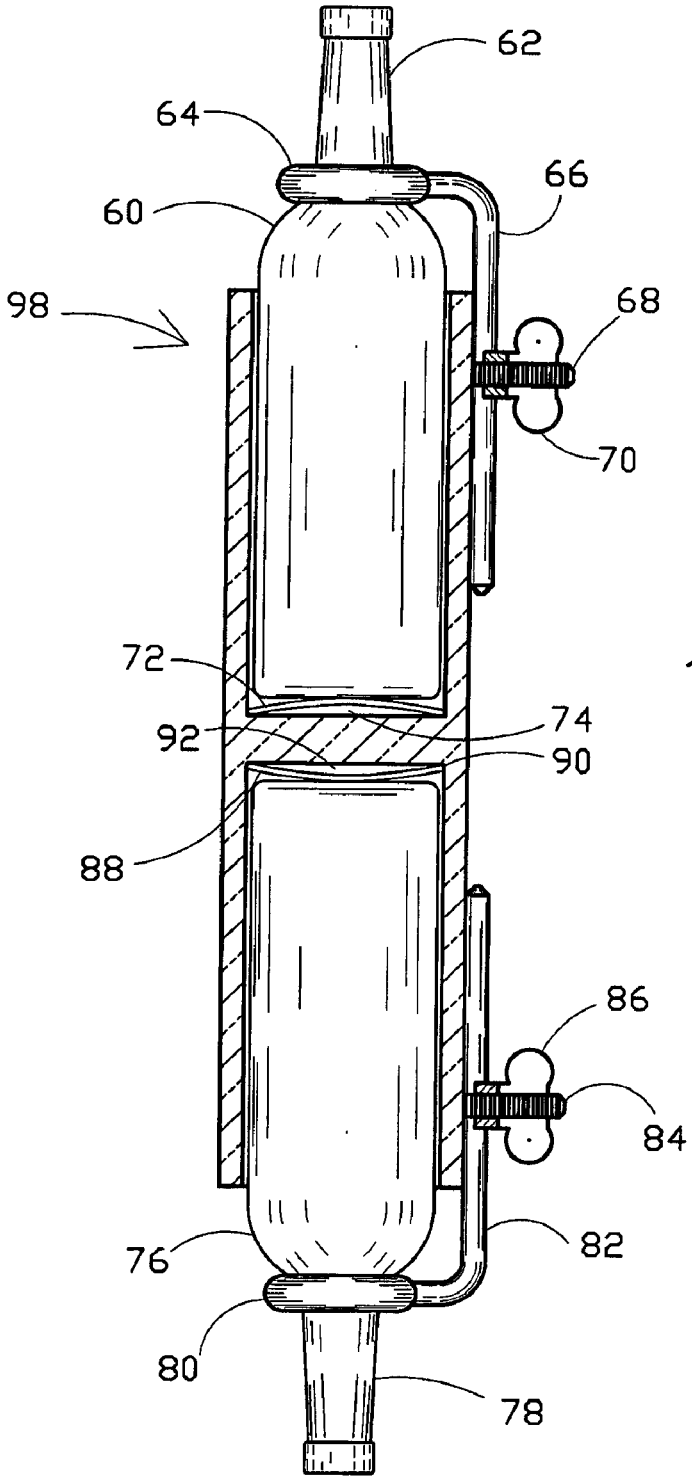
FIG. 9 is a side partial section view of an arrangement of two wine bottles each held in a sleeve with a spring urging each bottle towards a locking ring.
Figure 10:
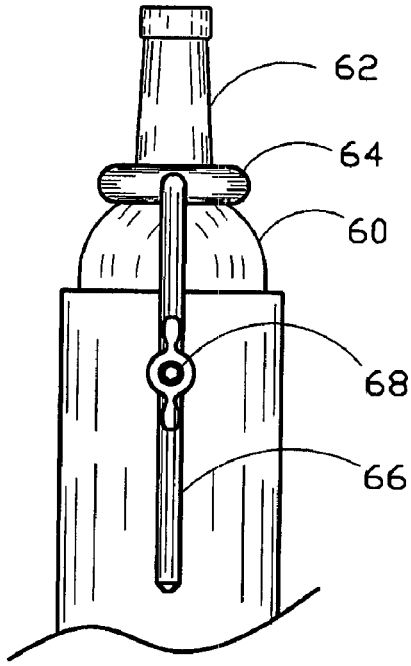
FIG. 10 is a partial side view from FIG. 9 showing the securing ring and locking screw.

In the embodiment of FIGS. 9-10, a vertical holder 98 has a first cavity 74 constructed and arranged to hold first bottle 60. Vertical holder 98 has a second cavity 90 constructed and arranged to hold second bottle 76. First bottle 60 is secured into position with a ring and 64 that encircles bottleneck 62. Securing rod 66 is operatively connected to ring 64 and extends along the side of vertical holder 98. Securing rod 66 is fixed into position and released as desired when wing nut 70 is either tightened or loosened about screw 70.

The securing arrangement is similar for second bottle 76. Second bottle 76 is secured into position with a ring 80 that encircles bottleneck 78. Securing rod 82 is operatively connected to ring 80 and extends along the side of vertical holder 98. Securing rod 82 is fixed into position and released as desired when wing nut 86 is either tightened or loosened about screw 84.

Figure 11:
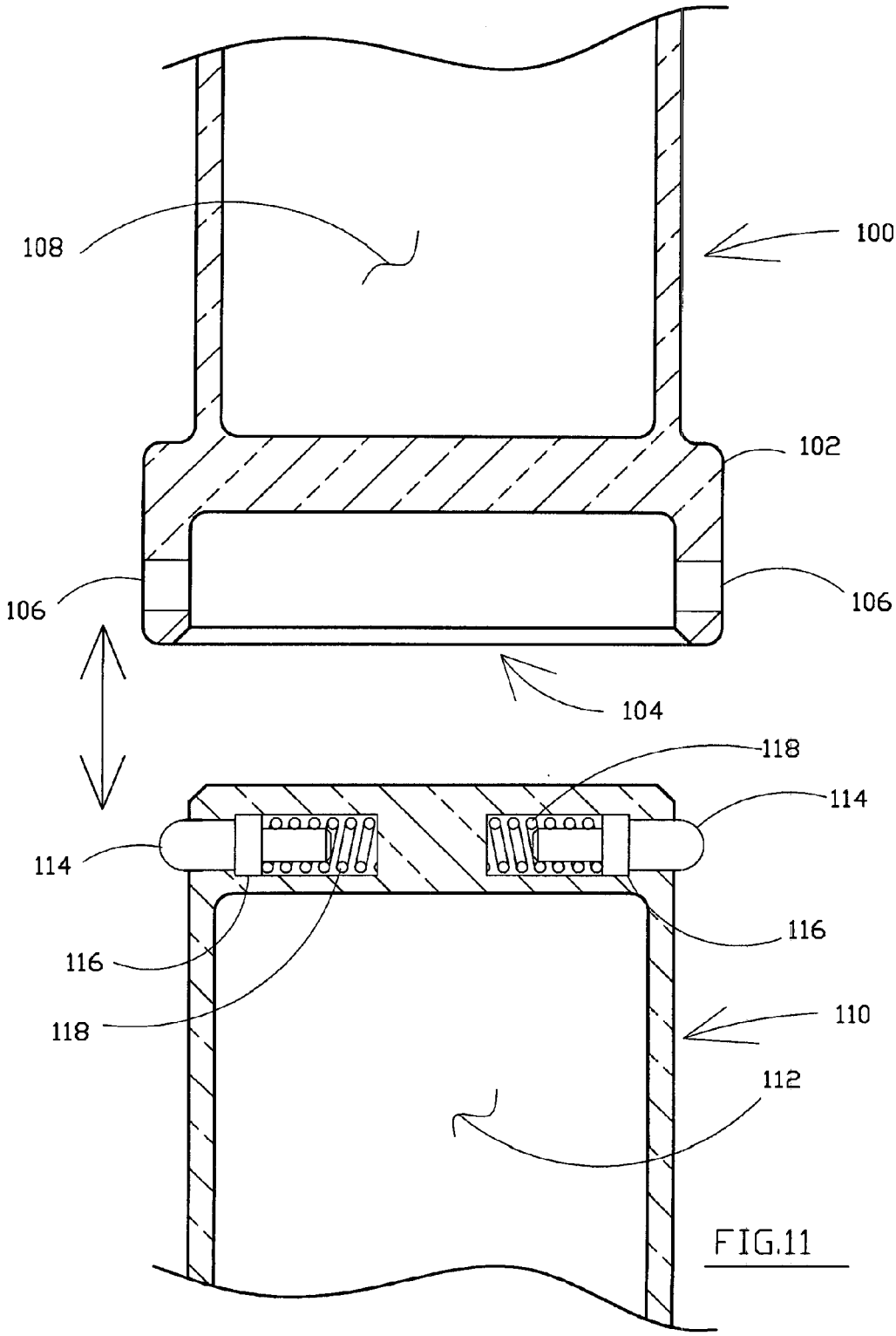
FIG. 11 is a section partial side view of separated two bottles, with the first bottle having a receiving ring incorporated into the base of the bottle and the second bottle having locking pins incorporated into the base of the bottle.
Figure 12:
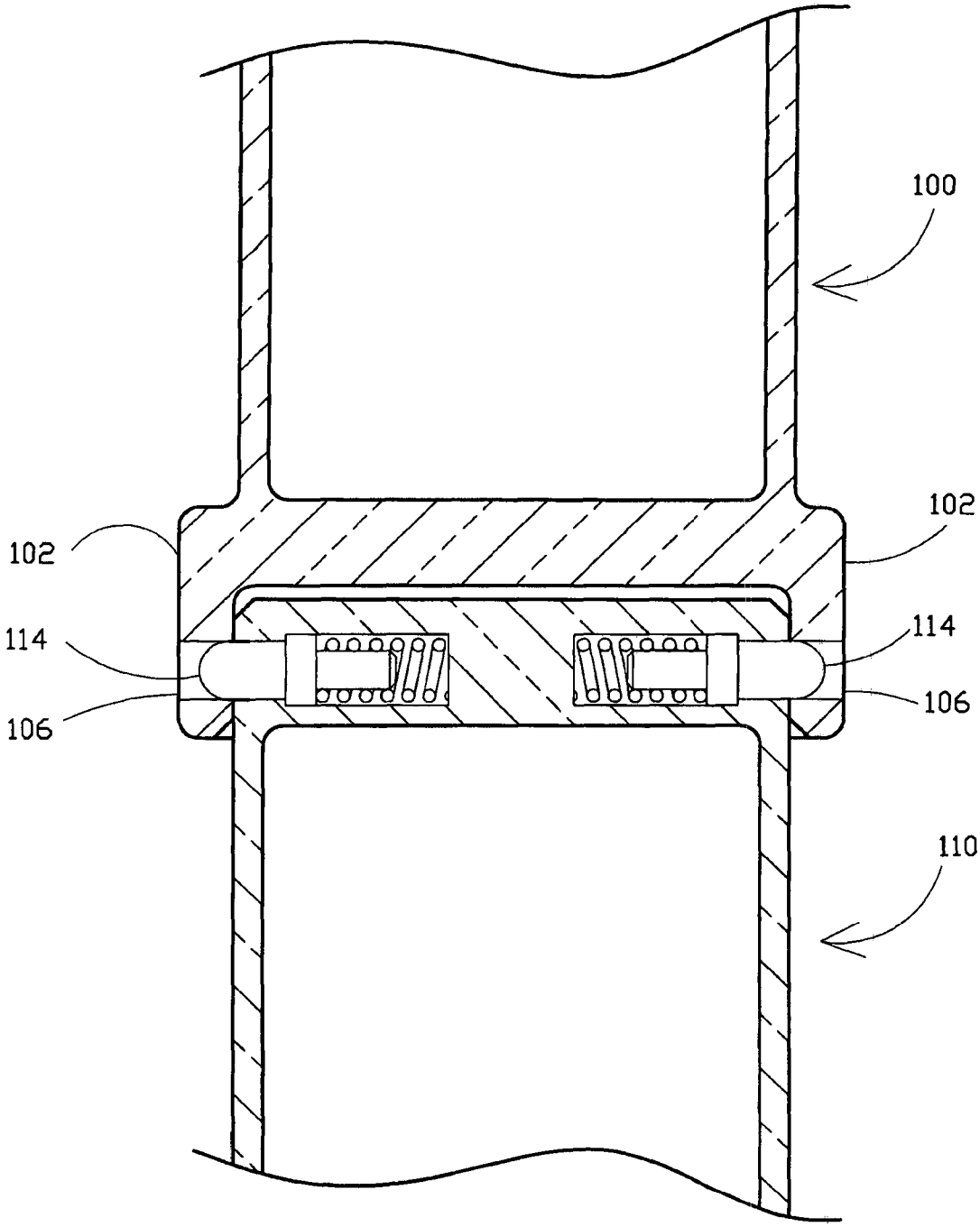
FIG. 12 is a section partial side view of connected bottles from FIG. 11.
Figure 13:
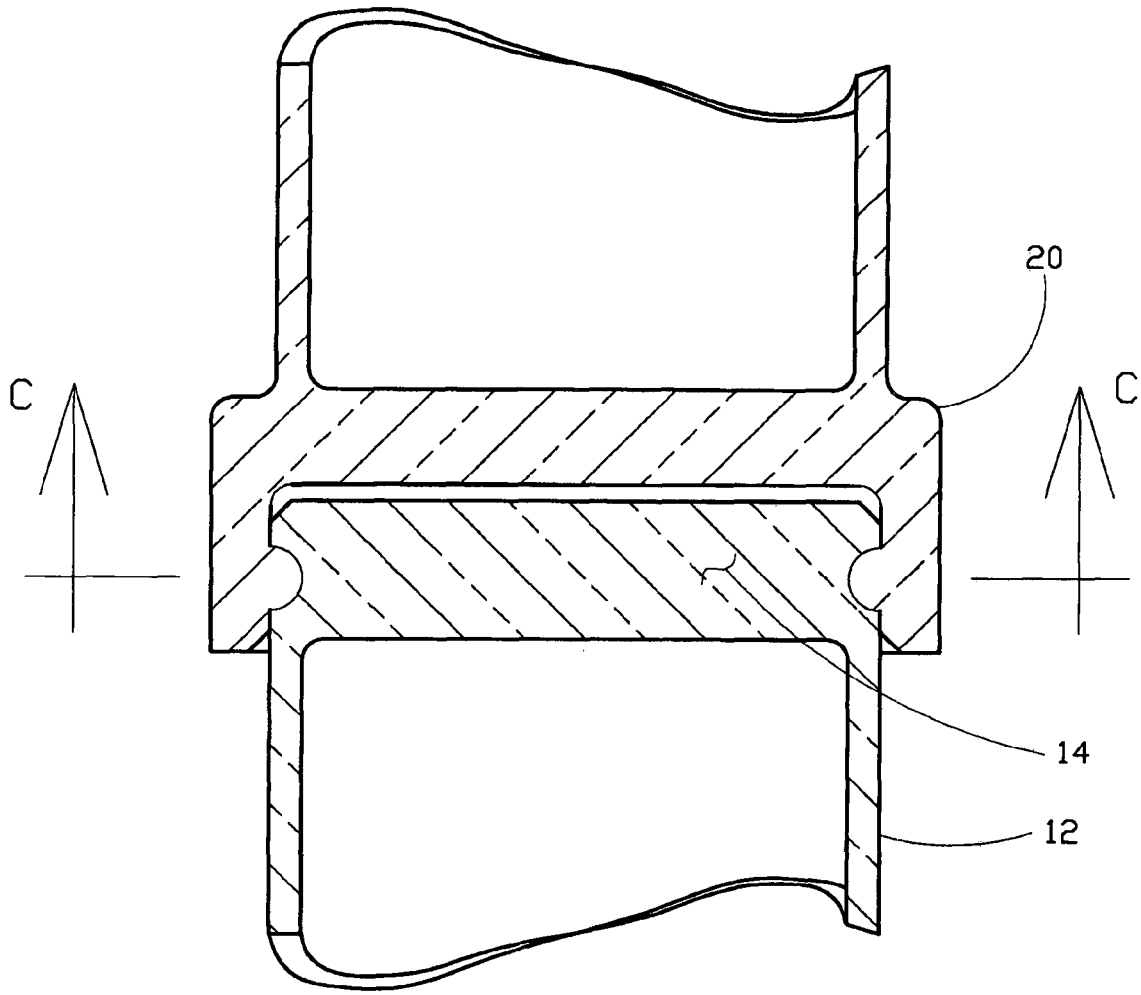
FIG. 13 is a section partial side view of connected bottles from FIG. 1.
Figure 14:
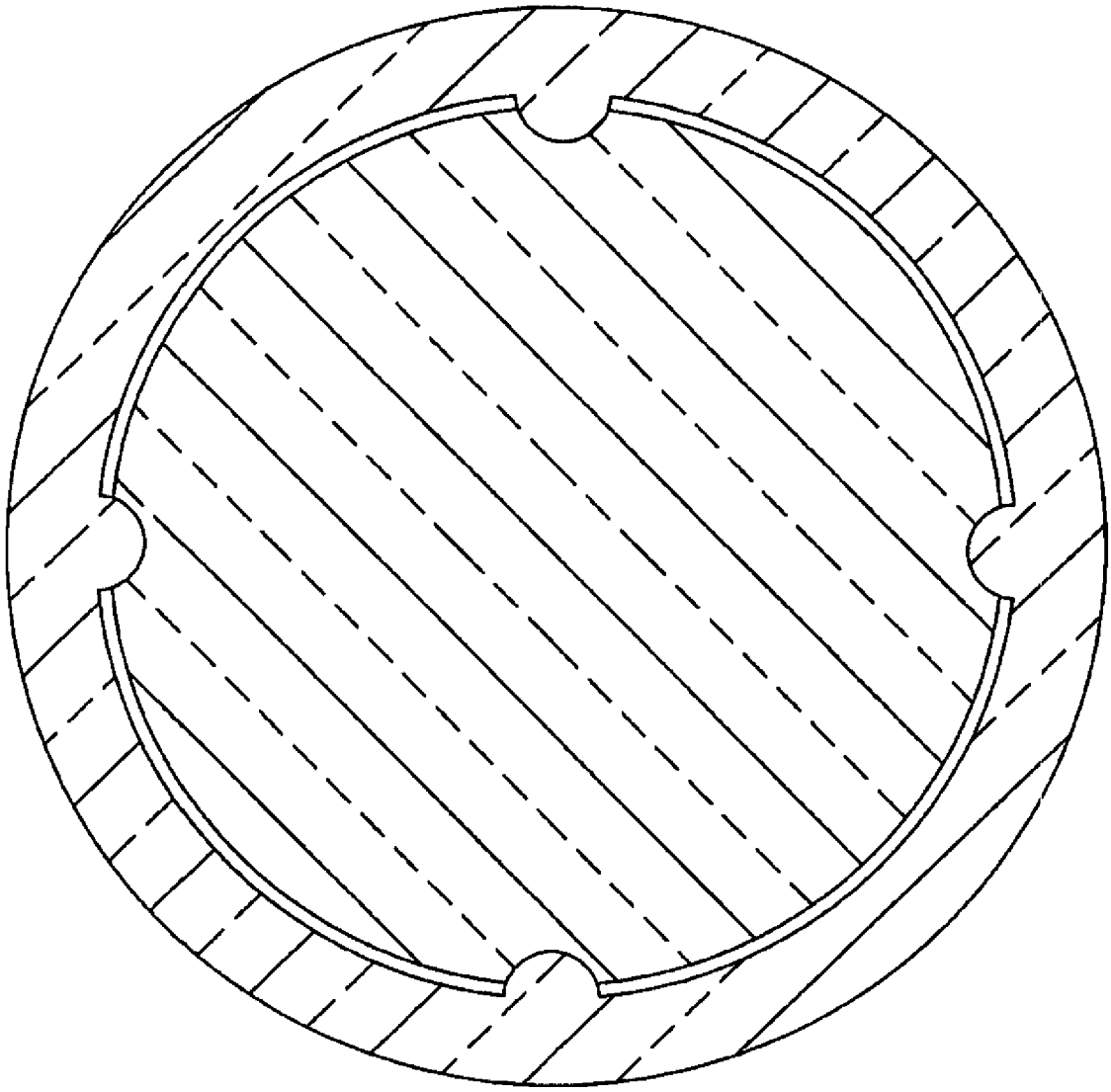
FIG. 14 is a section view along line C-C from FIG. 1.
Figure 16:
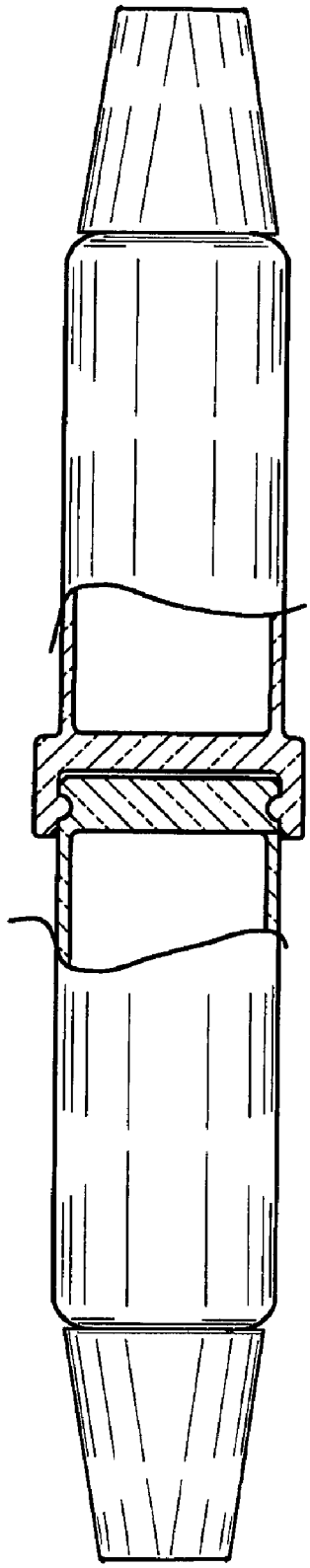
FIG. 16 is a partial section side view of two connected bottles from FIG. 1.

In the embodiment of FIGS. 11 and 12, first bottle 100 is constructed and arranged with receiving collar 102 that encompasses a receiving cavity 104. Second bottle 110 has incorporated therein pin 114, positioned within cavity 120 Cavity 120 is formed of rear wall 120*a*, circumferential side wall 120*b*, and front wall 120*c*. Each pin 114 is urged outward by spring 118 that is placed within cavity 120.

As depicted by FIGS. 11-12, each pin 114, is urged centrally inward when second bottle 110 is placed into receiving cavity 100 for a first bottle 100. When pin 114 is aligned with orifice 106, spring 118 urges pin 114 out word creating the desired interlocking relationship.

In the embodiment of FIGS. 15, 15A, and 15B, first bottle 130 is constructed and arranged with an interior cavity 132 that nests on bottleneck 138 of second bottle 136. A snap fit arrangement between male snap fit member 140 and female snap fit member 134 is accomplished when bottleneck 138 is placed fully inside cavity 132.

While the invention has been described in its preferred form or embodiment with some degree of particularity, it is understood that this description has been given only by way of example and that numerous changes in the details of construction, fabrication, and use, including the combination and arrangement of parts, may be made without departing from the spirit and scope of the invention.

I claim:

1. A system of connecting two bottles comprising:

a. a first bottle constructed and arranged with a connection means; and b. a second bottle constructed and arranged with a connection means;

wherein each of said first bottle connection means and said second bottle connection means secure two bottles in a configuration that provides only a single bottle be at least partially placed in ice or ice with water when connected bottles are placed in a tableside bottle serving chiller.

2. The system of claim 1 wherein said connecting means are a male-female snap fit configuration.

3. The system of claim 1 wherein either or both of said first bottle connection means and said second bottle connection means comprise spring-loaded locking pins.

4. The system of claim 1 wherein one of either said first bottle connection means and said second bottle connection means is a connecting collar.

5. The system of claim 1 wherein each of said first bottle connection means and said second bottle connection means are spring loaded locking pins and each bottle is joined by interaction with a connecting collar.

6. The system of claim 1 wherein each of said first bottle connection means and said second bottle connection means are bottle sleeves constructed and arranged with one open end and one closed end, at least one spring positioned in an interior base region of said closed end, said spring urges a bottle placed therein towards said open end, said bottle urged against a locking ring placed around a bottleneck.

7. A method of serving wine tableside comprising:

a. selecting a first wine to be served chilled;

b. selecting a second wine to be served at under room temperature;

c. providing a system according to claim 1;

d. providing a vessel containing ice, cold water, or a combination thereof;

e. connecting each of said first and second bottles, said first wine residing in said first bottle and said second wine residing in said second bottle;

f. placing said first bottle in said vessel;

g. waiting a sufficient time for said first wine in said first bottle to chill;

h. removing said system from said vessel;

i. serving wine selected from said first wine, said second wine, or a combination thereof.

* * * * *